United States Patent [19]

Upperman et al.

[11] 4,409,083

[45] Oct. 11, 1983

[54] CELL WITH COMPOSITE ANODE FOR ELECTROLYTIC PRODUCTION OF MAGNESIUM

[75] Inventors: Gary V. Upperman, North Olmsted, Ohio; James C. Withers, Tucson, Ariz.

[73] Assignee: Metallurgical, Inc., Lakewood, Ohio

[21] Appl. No.: 333,429

[22] Filed: Dec. 22, 1981

Related U.S. Application Data

[63] Continuation-in-part of Ser. No. 118,972, Feb. 6, 1980, Pat. No. 4,342,637, Ser. No. 944,987, Sep. 22, 1978, abandoned, Ser. No. 52,578, Jun. 27, 1979, abandoned, and Ser. No. 62,135, Jul. 30, 1979, Pat. No. 4,338,177.

[51] Int. Cl.[3] ..... C25C 3/04; C25C 7/02; C25C 7/04

[52] U.S. Cl. ..... 204/245; 204/282; 204/283; 204/289; 204/252; 204/268; 204/290 R; 204/291; 204/292; 204/70; 204/295

[58] Field of Search ..... 204/70, 67, 243 R, 244–247, 204/291–292, 294, 288–289, 279, 268, 254, 252, 295, 286, 283, 282, 290 R

[56] References Cited

U.S. PATENT DOCUMENTS

| | | | |
|---|---|---|---|
| 765,001 | 7/1904 | Gin | 204/294 |
| 4,214,956 | 7/1980 | Bowman | 204/70 X |
| 4,247,381 | 1/1981 | Schirnig et al. | 204/70 X |
| 4,342,637 | 8/1982 | Withers et al. | 204/294 X |

FOREIGN PATENT DOCUMENTS

| | | | |
|---|---|---|---|
| 1123837 | 2/1962 | Fed. Rep. of Germany | 204/70 |
| 2805374 | 8/1979 | Fed. Rep. of Germany | 204/67 |
| 452269 | 8/1936 | United Kingdom | 204/70 |
| 511076 | 8/1939 | United Kingdom | 204/294 |

*Primary Examiner*—Donald R. Valentine
*Attorney, Agent, or Firm*—Laurence R. Brown

[57] ABSTRACT

A cell for the electrolysis of magnesium at low temperatures and electrical potential using a composite anode consisting of a mixture of an oxygen containing compound of magnesium and a reducing agent with internal conductors extending through the composite mixture to provide low resistance current paths through the highly resistive mixture to the active anode surface. The mixture may be employed in a self-baking mode or be prebaked. Alternatively, the mixture may be in particulate form contained within a porous membrane. A bipolar arrangement may also be employed.

11 Claims, 11 Drawing Figures

FIG.1
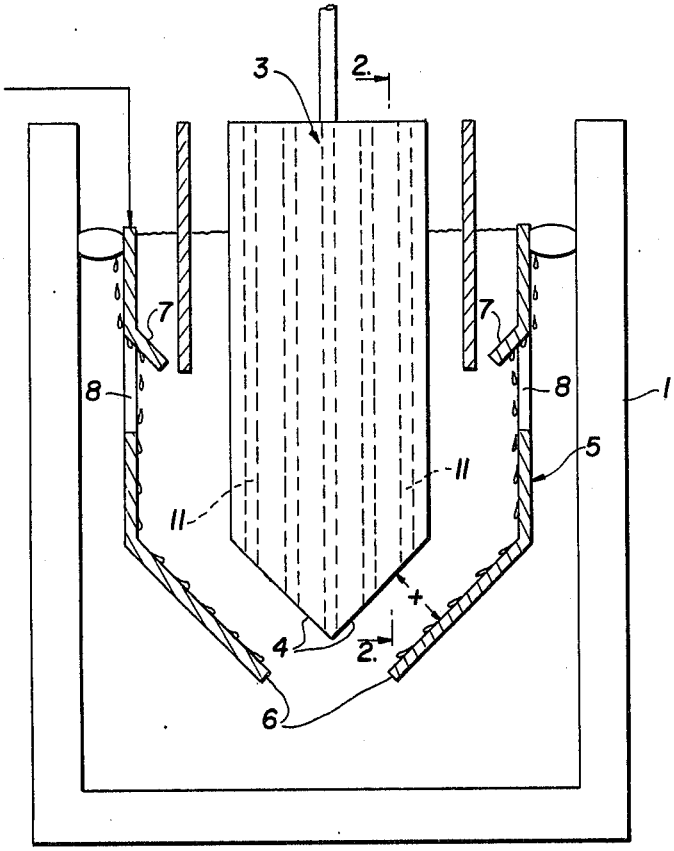
FIG.2
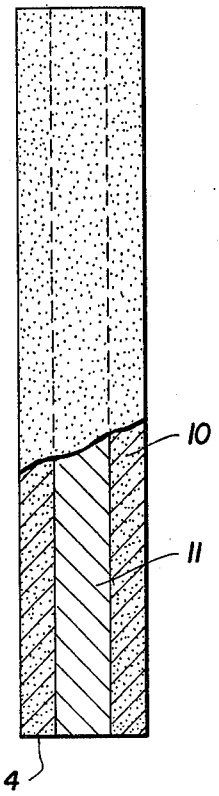
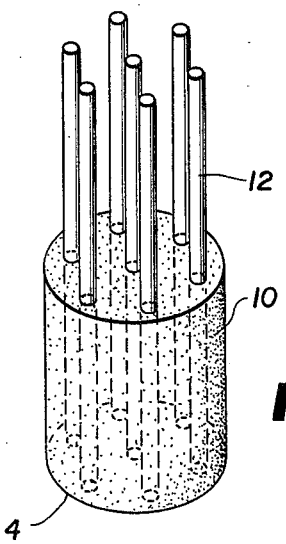
FIG.3

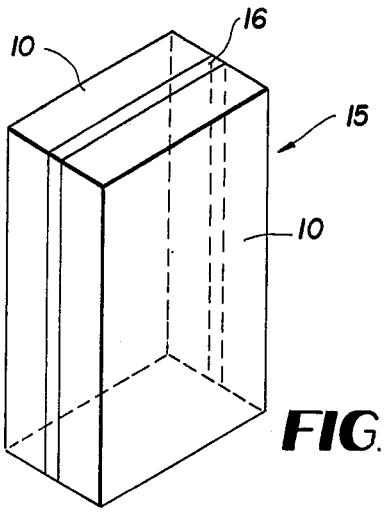
FIG.5
FIG.4
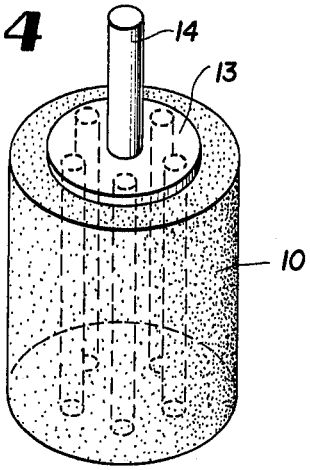
FIG.6A
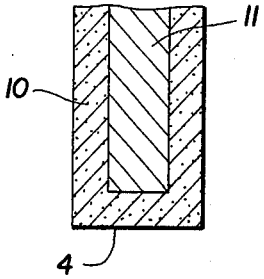
FIG.6B
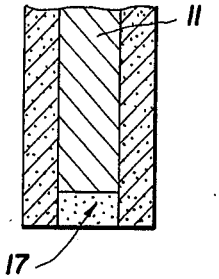
FIG.6C
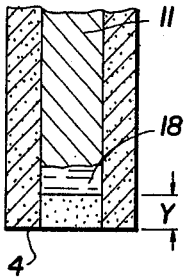
FIG.7
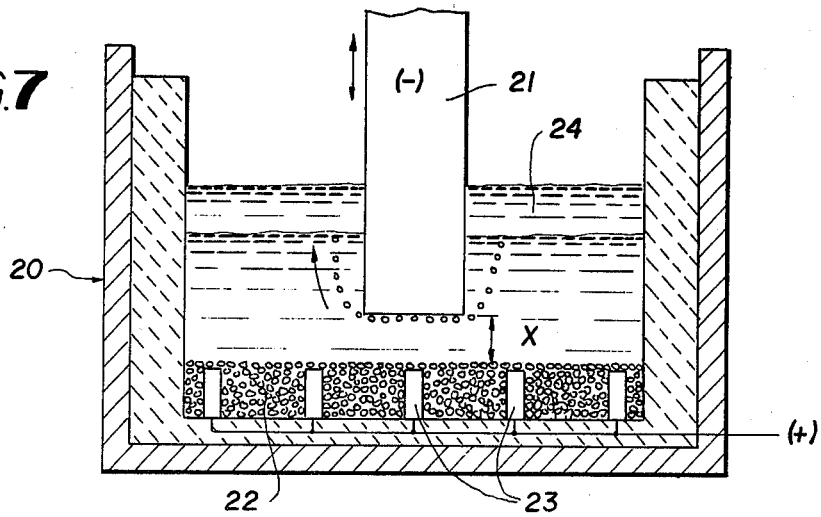

CELL WITH COMPOSITE ANODE FOR ELECTROLYTIC PRODUCTION OF MAGNESIUM

This application is a continuation-in-part of our copending application Ser. No. 118,972 field Feb. 6, 1980 now U.S. Pat. No. 4,342,637 granted Aug. 3, 1982, and its parent applications Ser. No. 944,987 filed Sept. 22, 1978 (now abandoned), Ser. No. 052,578 filed June 27, 1979 (now abandoned), and Ser. No. 062,135 filed July 30, 1978 now U.S. Pat. No. 4,338,177 granted July 6, 1982.

FIELD OF THE INVENTION

This invention relates to the electrolytic production of magnesium at energy saving low electrical potentials by using an anode comprising a mixture of magnesium oxide and a reducing agent which is immersed in a molten halide electrolyte with the magnesium ions released at the active surface of the anode being deposited as molten magnesium at a cathode.

BACKGROUND OF THE INVENTION

It has been proposed to produce magnesium in an electrolytic process by using as the anode a mixture of a reducing agent such as carbon, coke or graphite with the carbonates, hydroxides or oxides or magnesium. Exemplary of such proposals are British Pat. Nos. 452,269, 473,068, 5211,076 and 825,872. Cells employing such composite anodes offer the advantage of eliminating the need for a separate chlorination step to produce the magnesium chloride feed stock; they also eliminate the generation of chlorine gas in substantial quantities during the electrolytic process. These results are believed to be achieved because the nascent chlorine generated during the electrolytic decomposition immediately enters into reaction with the mixture and thereby produces in situ the chloride of the metal to be produced.

Notwithstanding the potential advantage of such arrangements, magnesium cells using composite anodes as described in the aforementioned patents have not met with any degree of commercial success. In large part, the lack of success has been due to the highly resistive nature of the composite mixture and the attendant large cell voltages, e.g., 20 volts, required to achieve current densities adequate for the commercial production of magnesium. Thus, the power consumption of such cells has been a major contributing factor in the lack of any commercial application of such cells.

Some efforts have been made to overcome the high resistance of these composite anodes. For example, British Pat. No. 511,076 suggests that conductor rods be laterally inserted in the anode and positioned near the surface of the bath to reduce the voltage losses. That arrangement, however, still leaves relatively long current paths through the highly resistive mixture to the active anode surface and has not, therefore, been a satisfactory solution to the problem.

Another proposal is described in British Pat. No. 825,872 in which a composite mixture to be used in a self-baking anode is supported by an outer metal shell and an internal reinforcing metal lattice work, both of which are connected to a source of electric power. However, since current flows through the path of least resistance, the principal current flow in that arrangement would be from the outer shell laterally through the electrolyte to the adjacent cathode. The inefficiency of the arrangement disclosed in this patent is apparent from the requirement that cell voltages be in the range of 10 to 20 volts. Cell voltages at that level are far in excess of voltage levels presently achieveable with existing commercial magnesium cells.

SUMMARY OF THE INVENTION

It is the principal object of this invention to provide a cell for the electrolysis of magnesium using an anode comprising a mixture of an oxygen containing compound of magnesium and a reducing agent, and in which internal conductors passing through the composite mixture are so arranged as to provide short, substantially constant, current flow paths through the resistive mixture to the active anode surface.

In a preferred formed of the invention the anodic mixture consists of magnesium oxide and carbon with a plurality of magnesium conductor rods extending through the mixture with each rod having an end thereof positioned adjacent the active anode surface. The rods are spaced apart a distance in the range of 1 to 6 inches and the rods are so dimensioned that the electrolytic transfer of the magnesium metal through the electrolyte to the cathode causes the rods to recess into the anodic mixture only a short distance and, thereafter, recede at a rate that approximates the rate at which the anodic mixture is consumed in the electrolyte process. With this arrangement, the anodic current path from the end of the conductor through the resistive mixture to the active anode surface remains substantially constant.

In an alternate form of the invention, the anodic mixture is in particulate form and contained within a membrane container which passes the electrolyte and ionic materials while restraining the particulate materials. Conductors of a non-consumable material are employed to provide short current paths to the active anode surface.

A further modification of the invention contemplates a bipolar arrangement in which a conductor is covered on one side with the anodic mixture.

THE DRAWINGS

FIG. 1 is a schematic illustration of an electrolytic cell incorporating the principles of the present invention;

FIG. 2 is a partly broken away fragmentary view illustrating the structure along line 2—2 of FIG. 1 showing the composite anode of the present invention;

FIG. 3 is a perspective view of one form of the anode of the present invention with multiple conductors;

FIG. 4 is a perspective view of a modified form of the anode of FIG. 3;

FIG. 5 is a fragmentary perspective view of an alternative form of the anode of FIG. 2;

FIGS. 6A, 6B and 6C illustrate, in fragmentary cross sectional views, various stages of the consumption of the anode and conductors;

FIG. 7 is a schematic view of an alternate form of cell;

DETAILED DESCRIPTION OF THE INVENTION

Figure 8:
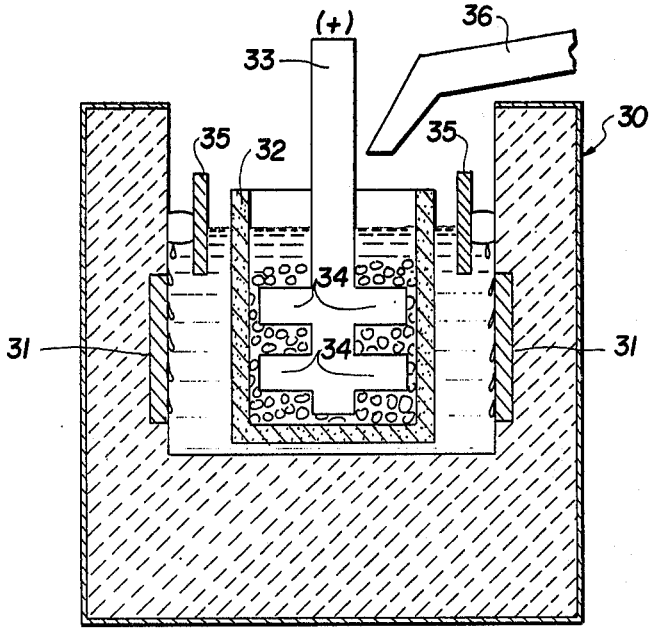
FIG. 8 is a schematic view of a cell using a membrane container for the anodic mixture.

Referring now to FIG. 1, there is schematically illustrated a cell incorporating the principles of the invention. The cell includes a housing 1 which may, for example, be composed of a steel shell of the type well known in the art. Contained in the cell is a suitable electrolyte which is preferably a molten fused halide salt containing ions of chloride, fluoride or mixtures thereof. It is preferred that the temperature of the bath is generally maintained in the 650° to 800° C. range.

An anode 3, details of which are described hereinafter, extends into the bath and is provided at its lower end with sloped active anode surfaces 4. A cathode comprising a steel shell 5 is positioned in the bath on either side of the anode 3. The cathode includes cathodic surfaces 6 which are complementary to and in opposed spaced relationship to the active anode surfaces 4. The cathode shell 5 includes inwardly directed louvers or inverted troughs 7 with openings 8, similar to the arrangement shown in U.S. Pat. No. 1,921,377.

Referring to FIG. 2, the anode is illustrated in somewhat more detail and comprises an anodic mixture 10 of an oxygen containing compound of magnesium, preferably magnesium oxide, and a suitable reducing agent. The reducing agent is not limited to any particular material; it could be any of those materials known to be effective to react with the carbonates and oxides of magnesium. Among the reducing agents that are particularly useful is carbon because it characteristically has the dual capability of carrying current to the reaction site as well as maintaining a reducing function. The source of carbon in the intermixture can be any organic material, particularly those having a fossil origin such as tar, pitch, coal and coal products and may also include natural and synthetic resinous materials such as the waxes, gums, phenolics, epoxies, vinyls and the like which may be coked. Coking of the carbon source intermixed with the oxides and the carbonates can be accomplished by known art techniques such as those used in prebaked anodes.

The proportion of the intermixture is at least 1.5 parts by weight of the oxide to 1 part of the reducing agent. As much as 20 or more parts by weight of the oxide may be employed, it being preferred that 2.0 to 7.5 parts by weight of the oxide be present per part of reducing agent.

The size and surface area of the particles making up the anodic mixture are not particularly critical. It is desirable, however, that the magnesium compound be in intimate physical contact with the carbonaceous material or other reducing agent. Homogeneous mixtures of powders or particles of the two materials is, therefore, particularly desirable.

While, to some extent, the conductivity of the anodic mixture varies depending on the manufacturing process and the amount of conductive reducing agent incorporated in the mixture, such mixtures are still highly resistive. The power losses that would be incurred in the anodic current traveling from the top of the anode down to the active surfaces 4 would be such that the cell would not be acceptable for commercial operation.

To reduce the power loss through the composite mixture, FIG. 2 illustrates a conductor 11 that extends the full length of the anode 3. The conductor is preferably of magnesium and may be coated with the mixture 10 on both sides, as shown in FIG. 2, or in certain applications it may be covered on only one side. The conductor 11 is connected at its upper end to a source of electrical power and, in effect, serves as a means for busing the anodic current from the power source through the otherwise highly resistive mixture down to the region of the active surface 4. In this way, the resistance of the greatest part of the mixture is effectively bypassed.

FIG. 3 illustrates a preferred form of the composite anode and internal conductor combination in which there are a plurality of magnesium rods 12 extending through the mixture 10 with each of the magnesium rods having its lower end positioned adjacent to the active surface 4 of the anode. The rods are spaced such that the voltage drop is minimized relative to the conductivity of the composite anode. The spacing between the outer surface of the anode and the surface of any of the rods 12 in FIG. 3, and the mutual spacing between the rods in FIG. 3, is preferably in the range of 1 to 6 inches, and most preferably 1.0 to 4 inches.

Various arrangements of the conductors may be employed. For example, in FIG. 4 the conductor rods 12 are shown to be connected to a plate 13 supported by a central conductor 14. In FIG. 5, the anode is in the form of a laminated block 15. The laminated block consists of the two sections of the composite mixture 10 between which are sheets of magnesium 16. These sheets, which are desirably spaced apart a distance comparable to the range specified for the rods 12, act in the same way as the magnesium rods in FIGS. 2 and 3 to conduct the current to the active surface.

The number and size of the conductors, whether rods 12 or sheets 16 of some other configuration, are selected based on anode size, current density, cell size, operating temperature and heat transfer considerations. In general, the conductors must be of sufficient cross-section to conduct the necessary anodic current to avoid major voltage drops in the anode.

The anode may be fabricated with the conductor 11 extending entirely through the anodic mixture 10 to the bottom active surface, as shown in FIG. 2. Alternatively, the conductors may terminate short of the bottom surface with the lower end of the conductors covered by the anodic mixture, as shown in FIG. 6A. Another alternative is for the conductors to terminate short of the bottom surface, leaving a recess 17.

Referring back to FIG. 1, a composite anode of the type described is positioned in complementary relationship to the inclined surfaces 6 of the cathode, with a predetermined spacing shown at X between the active anode surface and the cathode surface. The anode-to-cathode spacing X is desirably less than 1 inch with anode-cathode spacings above 2.5 inches greatly increasing the energy consumption due to the relatively high resistivity of the molten bath.

In operation, anodic current is carried by the conductors 11 through the resistive mixture 10 to the region immediately adjacent the active surface 4, thereby to provide short current paths from the lower end of the conductors through the anodic mixture to the active anode surface 4. While the precise mechanism by which magnesium ions are generated is not fully understood, the anodic mixture at the active surface is consumed and ionic magnesium is generated which is then collected as molten magnesium droplets on the cathode surfaces 6. The inclination of those surfaces may be selected such that the droplets of molten magnesium move along the surface up toward the inverted troughs 7. The metal entrapped by the troughs 7 moves outwardly through the ports 8 into the inactive space behind the cathode and, thereafter, rises through the heavier electrolyte and accumulates as a molten mass on the surface of the bath. The molten magnesium may be withdrawn from the cell by suitable techniques known to those in the art.

The anode 3 may be either prebaked or of the self-baking type and may be fed along its longitudinal axis to maintain the spacing x between the active anode and cathode surfaces as the anodic mixture at the active surface is consumed.

The magnesium conductors 11 which may be either initially exposed to the bath if fabricated as in FIG. 2 or 6B, or which become exposed to the bath as the anodic mixture is consumed if fabricated as in FIG. 6A, will tend to melt since the temperature of the bath is above the melting temperature of the magnesium. However, if properly dimensioned, the rate at which the magnesium conductors melt may be controlled. If the conductors are rods 12, the diameter of such rods is preferably 0.125 to 2.0 inches and most preferably 0.25 to 1.0 inch. In the case of sheets, the thickness is preferably 0.25 inches or less. It is, of course, to be understood that the melting of the magnesium conductors to a distance of, for example, 4 or even 6 inches does not affect the ability of the conductors to conduct anodic current to the active anode surface. This is so because the magnesium, being lighter than the electrolyte, will remain internally of the anode, albeit in molten form, and still be effective to transmit the current flow.

However, exposure of the conductors to the bath will cause electrolytic transfer of the exposed magnesium metal from the conductors to the cathode where it will be collected and form a part of the molten magnesium pool. This transfer of the metal itself will cause the conductors to recess a small distance into the anode body. This is pictorally illustrated in FIG. 6C in which the conductor 11 is recessed a distance Y from the anode surface 4 with the lower end of the conductor 11 having melted and being in a molten form as indicated at 18.

It is desirable to control the extent to which the metal conductors are electrolytically transferred to the cathode and to maintain the distance Y at no more than 2 inches. In part, this is achieved by the collection of gases in the recess in the anode. These gases serve as an insulator and limit the amount of the transfer. In addition, the electrolyte may rise into the recess formed by the transfer of the metal conductor and, due to the higher resistivity of the electrolyte as compared to the anodic mixture 10, there comes a point at which the ohmic resistance of the flow path from the end of the conductor through the electrolyte is so significantly greater than the path from the end of the conductor through the anodic mixture, that transfer of the metal will essentially cease. Thereafter, the current flow will be principally from the conductor through the anodic mixture to anodic surface 4 for the desired electrolytic reaction. As the anode surface 4 is consumed and recedes, there will be additional transfer of the metal conductor directly to the cathodes with the result that the conductors, after the recess distance Y has been established initially, will recede at a net rate approximately equal to the rate at which the anode surface is consumed so that the average effective distance Y will be maintained relatively constant. With an approximately constant distance between the end of the conductors and surface 4, the short current paths are maintained and the voltage drop through the anode is also essentially constant.

Referring now to FIG. 7, a modification of the invention is illustrated in which a cell 20 has the cathode 21 extending down into the molten halide slat electrolyte. The anode is positioned in the bottom of the cell and comprises a particulate mixture 22 of the oxygen containing compound of magnesium and the reducing agent. Conductors 23 which may, for example, be of graphite, project upwardly into the composite mixture 22 to provide the desired short, conductive paths to the upper surface which comprises the active anode surface of the mixture. In operation, the cell of FIG. 6 causes magnesium ions to collect on the under surface of the cathode 21 and droplets of the magnesium metal then rise to the surface of the bath where it is collected in a pool 24. As will be appreciated, a suitable screen or other mechanism may be laid across the layer 22 to retain the particulate mixture at the bottom of the cell.

A loose particulate mixture of the anodic material may also be employed in a cell such as that illustrated schematically in FIG. 8. In that cell, indicated generally by the reference number 30, the cathodes 31 are positioned on either side of the cell wall. The anode comprises a membrane container 32 in which the composite mixture of the oxygen containing compound of magnesium and the reducing agent is disposed. A central conductor 33 with laterally extending branches 34 is positioned within the anodic mixture. The conductor is non-consumable and is, preferably, graphite. Suitable dividers or dikes 35 may be employed to separate the collected molten magnesium from contact with the membrane 32.

The membrane physically restrains the materials comprising the anodic admixture and holds the materials in close contact with the conductor. In addition, the membrane permits the free passage of the electrolyte and ionic particles but will substantially reject the molten magnesium and undissolved solid materials that are present in the anodic mixture.

The external shape of the membrane is only schematically illustrated in FIG. 8 and may be any suitable shape. In general, the through passage porosity (the percentage of the total volume of the membrane that is made up of passages that pass from one side of the membrane to the other) of the membrane will vary with the nature of the membrane material and its fabrication. The greater the porosity, the greater is the current flow and, therefore, the greater the electrical efficiency. The preferred porosity to achieve the lowest voltage drop is in the 90% to 97% range, but the porosity generally may be acceptable in the range of 30% to 70%.

The necessary connected pore size (i.e., the smallest diameter of a passage through the membrane) is a function of several variables including the temperature of the molten bath and the salt composition; but the common characteristic of useful membranes is that the porosity must be sufficient to pass all the metal ions such as a magnesium and all the electrolyte salts without passing the undissolved particles.

The thickness of the membrane material is a function of its porosity, pore size and ability to retain undissolved impure solids and molten metal. Obviously, the thicker the membrane the greater the electrical resistance. It is, therefore, desirable to use as thin a membrane as is practical consistent with the porosity and pore size standards as well as the mechanical strength of the membrane necessary for the cell. The preferable thickness is 0.125 to 0.5 inch but may be as thick as 2.0 inches or more and, in certain applications, may be less than 0.125 inch.

Typical membrane materials that may be useful include, but are not limited to, vitreous carbon foam, carbon or graphite in the form of a porous solid, felt or cloth. Aluminum nitride, silicon nitride, silicon carbide, silicon oxynitride, boron nitride and titanium nitride may also be used as a porous solid, as a cloth or as a coating on the surface of a vitreous carbon foam or porous graphite. Aluminum nitride appears to be the most desirable material. The use of a membrane permits much closer spacing between the anode and the cathode with spacings on the order of 0.25 inches being entirely feasible.

The anodic mixture in the membrane container may be periodically replenished simply by dumping the mixture into the container 32 by suitable means such as illustrated schematically at 36.

As will be appreciated, although only a single membrane container is illustrated in the embodiment of FIG. 8, a cell having a multiplicity of such containers with a cathode between adjacent containers could be employed.

Figure 9:
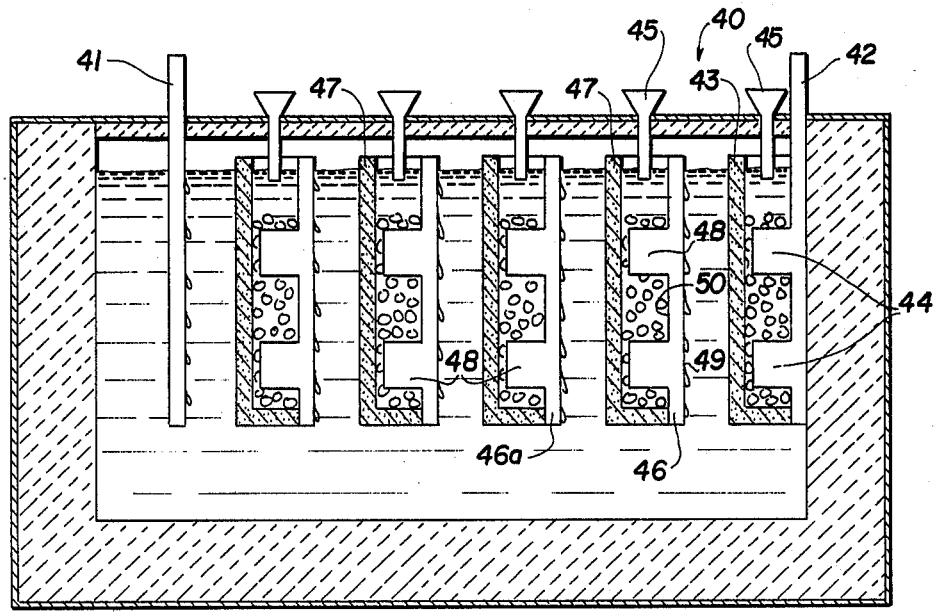
FIG. 9 is a schematic view of a cell with composite anodes and conductors arranged in a bipolar configuration.

Referring to FIG. 9, a further modification of the invention is illustrated in which a cell, indicated generally at 40, is constructed to operate in a bipolar mode. The cell includes a cathode 41 which may be graphite, steel or other suitable material. An anode 42, preferably of graphite, is located at the opposite side of the cell. The anode 42 cooperates with a membrane container 43 to define a compartment in which the anodic mixture previously described is disposed. The anode 42 may have lateral branches 44 which extend through the anodic mixture and suitable means 45 may be provided to replenish the anodic mixture in the container as it is consumed.

Between the cathode 41 and the anode 42 is a group of spaced electrodes which are unconnected to each other or to any electrical source. Each of those electrodes consists of a conductor 46 cooperating with a membrane container 47 in which the anodic mixture is disposed. Each of the conductors 46 may also be provided with lateral conductor branches 48. The conductor 46 is preferably graphite or another suitable material. The membrane 43 cooperating with the anode 42 and the membranes 47 cooperating with the conductors 46 are of the same type as that discussed in connection with FIG. 8 and serve the same function. Suitable dikes such as those in FIG. 8 may be used to channel and confine the molten mechanism.

In operation of the bipolar cell of FIG. 9, the side 49 of the electrode 46 adjacent the anode 42 become negatively charged and the side 50 of the electrode facing the cathode 41 becomes postiively charged. The side 49, therefore, acts as the cathode for collection of the magnesium ions generated by electrolysis of the anodic material in the membrane 43. The current flow for this reason is from anode 42, through branches 47 to the active surface of the mixture, and then through the electrolyte to the cathodic face of the conductor 46 of the next adjacent electrode. As is understood by those in the art, the current will then flow through conductor 46 and branches 48 to the active surface of the anodic mixture facing the next adjacent conductor 46 where the process will be repeated.

In both of the arrangements of FIG. 8 and FIG. 9, the lateral branches 34, 44 and 48 of the conductors serve as a conductor means to transmit the anodic current through the otherwise resistive anodic mixture to the active anode surface which is adjacent to the internal surface of the membrane material. In this way, relatively short current flow paths from the end of the conductor through the adjacent anodic mixture are maintained.

While the invention has been described with reference to certain preferred embodiments, neither the illustrated embodiments nor the terminology employed in describing them is intended to be limiting; rather, it is intended to be limited only by the scope of the appended claims.

What is claimed is:

1. An anode for the electrolytic production of magnesium comprising, an anodic mixture of an oxygen containing compound of magnesium and an electrically conductive reducing agent, said anodic mixture including at least a portion thereof adapted to be immersed in an appropriate electrolyte with at least one active surface of said portion providing an active anode surface at which the magnesium oxide may be converted to magnesium ions recoverable as molten magnesium at the surface of a cathode, conductor means of higher electrical conductivity than said anodic mixture extending internally through said mixture, said conductor means comprising a plurality of individual spaced apart magnesium members each having one end extending out of said portion of said mixture and an internal end positioned at least approximately adjacent said one active surface for transmitting anodic current directly to at least the mixture adjacent to said surface thereby providing short low resistant current paths through the mixture to said surface, the spacing between adjacent magnesium members being in the range of 1 to 6 inches, said one end of each of said magnesium members being adapted to be connected to a source of electrical power whereby substantially the entire anodic current is transmitted through said conductor means to said active surface, each of said magnesium members having a substantially constant cross-section throughout its length and of a size whereby the electrolytic transfer of the magnesium from said members during the electrolytic process causes said members to be recessed only a short distance into the body of said anodic mixture and thereafter said internal ends of said members relative to said active surface are consumed at an average net rate approximately equal to the rate at which said anodic mixture at said surface is consumed in the electrolytic process.

2. The anode of claim 1 wherein said members comprise magnesium sheets having a thickness of approximately 0.25 inch or less.

3. The anode of claim 1 wherein said members comprise magnesium rods having a diameter in the range of 0.125 to 2 inches.

4. An anode for use as the sole source of magnesium in the electrolytic production of magnesium comprising a mixture of an oxygen containing compound of magnesium and a reducing agent including carbon, at least one conductor of higher electrical conductivity than the mixture in contact with said mixture for conducting electric current to said mixture in contact with an electrolyte, said conductor comprising a bipolar electrode structure presenting anode and cathode faces for operation in electrical contact with the electrolyte, the anode face of said electrode structure comprising said mixture of magnesium oxide and said reducing agent with said electrode being covered on one face only with said mixture.

5. The anode of claim 4 and including a membrane porous to electrolyte, said membrane cooperating with said electrode to form a compartment for said mixture.

6. An electrolytic cell for the production of a metal comprising in combination, an electrolyte disposed in the cell, said electrolyte including ions selected from the group consisting of chlorides, fluorides or mixtures thereof, a cathode immersed in the electrolyte presenting a surface for electrolyte winning of molten metal, an anode body comprising a mixture of an oxygen containing compound of the metal and an electrically conductive reducing agent which mixture serves as a sole source of the metallic ore and is consummable in the electrolytic process, said body having at least one active surface positioned in opposed relationship to but at all positions equally spaced from the surface of said cathode for providing an active anode surface at which the metallic oxide may be converted to metal ions recoverable as said molten metal at the opposing surface of said cathode, longitudinally extending conductor means of higher electrically conductivity than said anodic mixture and being covered on at least one face thereof with said mixture, said conductor means including at least one laterally extending branch thereof extending through said anodic mixture and having and end thereof positioned at least approximately adjacent said one active surface for providing short low resistant current paths from said one end through the mixture to said active surface, and means for connecting a source of electrical power to said conductor means and said cathode whereby substantially the entire anodic current flows directly from said power source through said conductor means and at least the mixture adjacent the end of said conductor means and therefrom through the electrolyte to said active surface.

7. The cell of claim 6 wherein said conductor means is of graphite.

8. The cell of claim 6 and further including a membrane porous to electrolyte, said membrane cooperating with said conductor means to form a compartment for said mixture.

9. The cell of claim 6 and further including a membrane porous to electrolyte and providing a compartment for said anodic mixture.

10. A cell as defined in claim 6 having means disposed therein for recovering the molten metal from the electrolyte in a segregated zone positioned to prevent the metal from electrically shorting the electrodes.

11. An electrolytic cell for the production of magnesium comprising in combination, a housing having sidewalls and a bottom surface, an electrolyte in the cell, said electrolyte including ions selected from the group consisting of chlorides, fluorides or mixtures thereof, a cathode immersed in the electrolyte presenting a surface for electrolytic winning of molten magnesium, an anode comprising a particulate mixture of an oxygen containing compound of magnesium and an electrically conductive reducing agent, which mixture serves as a sole source of magnesium ore and is consumable in the electrolytic production of magnesium, said mixture being immersed in the electrolyte beneath said cathode surface with the upper surface of said mixture providing an active anode surface, a plurality of conductor means of higher electrically conductivity than said mixture projecting upward from the bottom surface of said cell, said conductor means extending internally through said mixture with each having an end thereof positioned at least approximately adjacent said upper surface of said mixture, and means for connecting a source of electrical power to said conductor means and said cathode.

* * * * *